United States Patent [19]

Biotteau

[11] 4,312,286

[45] Jan. 26, 1982

[54] SEWING MACHINE ADAPTED TO STITCH ON A CURVED PATH

[76] Inventor: Gerard Biotteau, Les Zinnias, Saint Pierre Montlimart (Maine et Loire), France

[21] Appl. No.: 145,499

[22] Filed: Apr. 29, 1980

[30] Foreign Application Priority Data

May 11, 1979 [FR] France ..... 79 12011

[51] Int. Cl.[3] ..... D05B 27/00; D05B 27/22

[52] U.S. Cl. ..... 112/308; 112/315

[58] Field of Search ..... 112/308, 309, 315, 314, 112/316

[56] References Cited

U.S. PATENT DOCUMENTS

| | | | |
|---|---|---|---|
| 2,723,635 | 11/1955 | Matuzas | 112/315 |
| 3,139,051 | 6/1964 | Story | 112/308 |
| 3,609,373 | 9/1971 | Desai et al. | 112/308 X |
| 3,742,879 | 7/1973 | Schaefer et al. | 112/309 X |
| 4,100,864 | 7/1978 | Babson et al. | 112/308 X |
| 4,135,460 | 1/1979 | Biotteau | 112/308 X |

FOREIGN PATENT DOCUMENTS

| | | |
|---|---|---|
| 2608859 | 9/1977 | Fed. Rep. of Germany . |
| 2230778 | 12/1974 | France . |

*Primary Examiner*—H. Hampton Hunter

*Attorney, Agent, or Firm*—Young & Thompson

[57] ABSTRACT

Sewing machines comprising automatic guide apparatus for the piece, have a presser foot adapted to bear against the piece during operation so as to turn the piece, this bearing of the presser foot being controlled by a detector. A device for regulating the stitch length and a device for regulating the speed of operation of the machine are provided, and the control device for stitch length and the control device for the speed of driving of the piece are actuated by application of the guiding presser foot so as to increase the stitch length and reduce the speed as long as the presser foot is applied, that is, so long as the machine is stitching around a curve.

1 Claim, 6 Drawing Figures

SEWING MACHINE ADAPTED TO STITCH ON A CURVED PATH

The present invention relates to sewing machines comprising apparatus for automatically guiding the line of stitching about a curve.

Such machines are described particularly in French Pat. No. 74 16917 of May 15, 1974 and in its Certificate of Addition No. 76 11707 of Apr. 21, 1976 for "Apparatus for automatically guiding the piece in a sewing machine".

This guide mechanism essentially aims at automatically slowing the rotation of the piece counterclockwise when the edge of the piece to be "seamed" or "bound" has a convex curvature. By "seamed" is meant assembly by stitching the edges of two superposed pieces and by "bound" the application of a strip folded over both sides of the edge of the piece. Guiding is, generally speaking, in the device described in this French patent and its Certificate of Addition as well as in the devices disclosed, for example, in U.S. Pat. Nos. 2,917,483, 3,598,070 and 3,752,097, the disclosure of which is incorporated herein by reference, ensured by a presser foot which bears against the piece at the theoretical center of rotation whilst the piece continues to be driven by the feeder teeth and the needle or other drive devices depending on the type of machine. The engagement of the presser foot is controlled by a detector, either mechanical or with a photoelectric cell, which detects the apparent movement, in the direction of the presser foot, of the edge of the piece.

The operation of this guide device is explained in detail in French Certificate of Addition No. 76 11707 of Apr. 21, 1976 published Nov. 18, 1977 as No. 2,348,993. This Certificate of Addition describes in detail the operation of a guide apparatus which permits producing within 5 millimeters of the edge of the piece and for example 3 millimeters from its edge, stitching whose path has convex curves of a radius less than about 20 millimeters, which radius can be as small as about 7 to 8 millimeters. It is however pointed out in this Certificate of Addition that the apparatus "ensures a constant radius of curvature with slight crowding of the stitch which is slightly shorter in the curved zone, the constraint imposed on the material being released during the period of disengagement of the needle and of the drive device". It is indicated in this text that the crowding of the stitch about the convex curves comprises an advantage because the binding will be better applied in the region where it has a tendency to wrinkle and because the finished appearance of the piece will be better. In fact, however, this irregularity of the stitch combines with a certain irregularity of the path and results in a poor appearance which, if it is acceptable in the fabrication of mass produced goods, constitutes a serious disadvantage in the case of high priced goods and in the case of stitching effected with a thread which is fairly thick or of a color that contrasts with the piece.

This defect resulted from the inherent principle of operation of the guide device, the presser foot braking the piece of more or less deformable material while the latter is periodically driven by drive means which, for each stitch, return rearwardly to again grasp the piece and advance it the theoretical length of the stitch so as to effect a new stitch. The "springiness" of the material of the piece causes it to follow somewhat the drive means during the period where the edge of the piece is free, the piece being maintained gripped by the presser foot at a certain distance from the line of positive drive which is the line of action of the drive means. It therefore appeared impossible to correct this and the defect was considered as a counterpart of the high speed of stitching which can be realized with a machine provided with this guide apparatus.

The object of the present invention is to correct this drawback in a simple manner.

According to the invention the guide apparatus, mounted in known fashion on a sewing machine comprising means for controlling the stitch length and means for controlling the speed of operation of the machine, is characterized by apparatus for increasing the length of the stitch and by apparatus for reducing the drive speed of the piece both of which are controlled by the actuation of the guide presser foot.

When acting on the apparatus for regulating the stitch length, one increases the length of the step of the needle and of the positive drive devices such as the driving teeth, which elongation should correspond substantially to the amplitude of the "rearward return" of the material comprising the piece. The combination of these two factors "driving with a greater step" and "rearward return" should theoretically result in a practical length of the stitch in the curved portions of the stitching which is substantially uniform and equal to that of the stitch in the straight portions.

The "rearward return" varies according to the nature of the material on which stitching is performed and also varies according to the nature of the thread used and the length of the stitch. The control apparatus for variation of the length of the stitch acting or not according to whether it is subjected or not to the actuation of the guide presser, it is preferred to provide in the transmission a control of the relationship between the action of the control device and the action of the device for controlling the length of the stitch or to provide means for limiting the action of the control device for the length of the stitch so as to take account of these particular factors. This regulation may be effected by trial and error in the course of the overall control of a series of pieces.

Moreover a very high speed of operation of the order of 3000 stitches per minute, such as is possible during straight stitching, is too high during the time when the piece must rotate about the presser foot. It has been noted that the piece's own inertia prevents turning in a uniform manner and that the radius of curvature of stitching tends to "open", the portion of the stitching at the exit from the bend being displaced outwardly. As a result and according to a second characteristic of the invention whose combination with the increase in length of the stitch is necessary to obtain the result, the control device of the presser foot also controls a reduction in speed of the drive apparatus of the piece such as the needle and the driving teeth, which is to say in practice of the general drive motor of the machine.

The controls of the apparatus for regulating the length of the stitch and of the apparatus for regulating the speed of the machine are preferably effected by control devices of the same type as that which actuates the presser foot. These control devices can, accordingly, be constituted by a pneumatic or hydraulic jack in combination with an electromagnetic valve or an electromagnet with or without a mechanical transmission.

The invention will be described in greater detail hereinafter with reference to the attached drawings in which.

Figure 1:
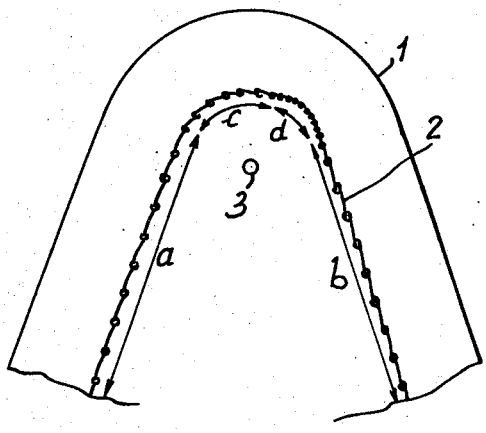
FIG. 1 is a view on an elarged scale of stitching performed with guide apparatus according to French Certificate of Addition No. 76 11707 with a "constant stitch length" and a "constant speed"

FIGS. 1 to 4 show stitching 2 produced on the corner of a shoe tongue 1 of cloth-lined sheep skin. In FIG. 1, the stitching is effected with the aid of a machine provided with a guide apparatus such as that described in French Certificate of Addition No. 76 11707, the stitch length being adjusted at 3 mm. As can be seen in the figure, in the approach zone a and in the exit zone b, the stitch length is regular and the stitching follows a correct path. On the contrary along the length of the stitching during the production of which the presser foot bears against point 3, there will occur a portion c in which the path of the stitching remains approximately correct but with a shortened stitch length having a length of about 1 mm followed by a portion d in which the path is irregular with shorter and shorter stitches.

Figure 2:
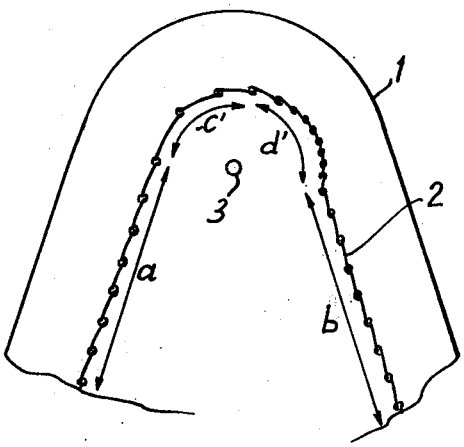
FIG. 2 is a view similar to FIG. 1 with elongation of the stitch length without reduction of the speed.

In FIG. 2, the stitching is effected on the same machine as the stitching of FIG. 1, but the latter is provided with a device for modifying the stitch length. Thus, when the presser foot bears against 3, the stitch length is increased from 3 mm to 4.5 mm. In this case, one finds after the approach zone a and at the moment of application of the presser foot, a zone c' in which the stitch is elongated followed by a zone d' in which the path becomes irregular and displaced toward the exterior the stitch being greatly shortened.

Figure 3:
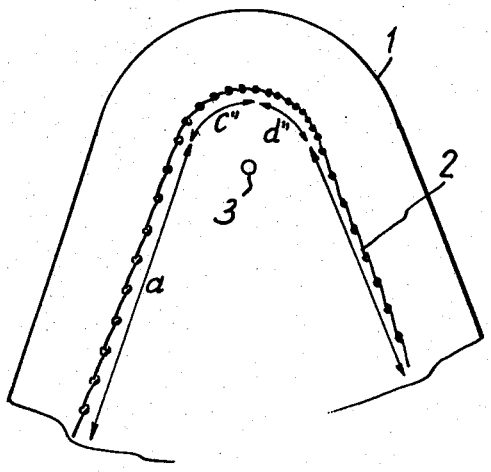
FIG. 3 is a view similar to FIG. 1 with reduction of the speed without modification of the length of the stitch.

The stitching of FIG. 3 is performed on the same machine as that of FIG. 1, said machine having been provided with a device for regulating the speed which permits decreasing the speed of the machine from 3000 stitches per minute to 900 stitches per minute during application of the presser foot at 3. In this case, the path obtained at c'' and d'' is regular but the stitch length decreases progressively from the entrance toward the exit of the zone, the medium length falling at one millimeter which does not give regular stitching.

Figure 4:
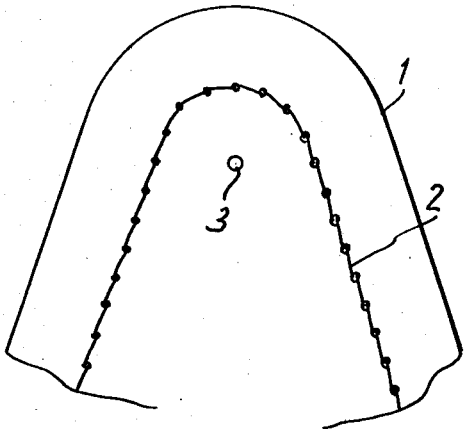
FIG. 4 is a view on the same scale of stitching produced with the machine modified according to the invention.

In FIG. 4, the stitching is performed with the same machine as that of FIG. 1. However, in this case, the machine is provided with apparatus permitting both the modification of the stitch length and the control of the speed according to the present invention. When the presser foot bears at 3 the stitch length has been increased from 3 mm to 4.5 mm and the speed of the machine which was 3000 stitches per minute has been reduced during the application of the presser foot to 900 stitches per minute. As can be seen the curvature of the stitching which had a radius of curvature of 6 mm has no irregularity and the stitch length remains constant.

Figure 5:
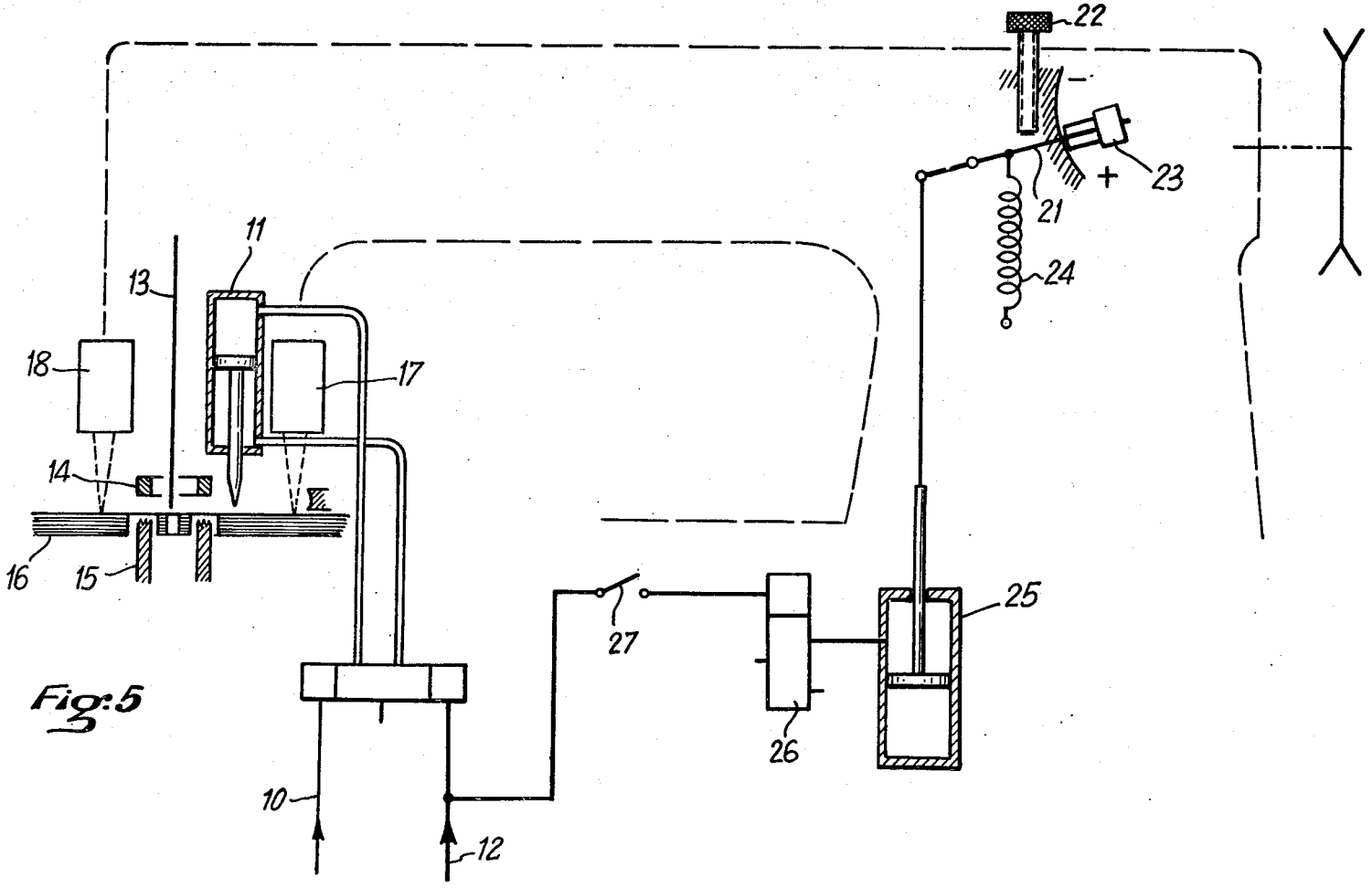
FIG. 5 is a schematic view of the guide apparatus according to the invention which relates to the stitch length.
Figure 6:
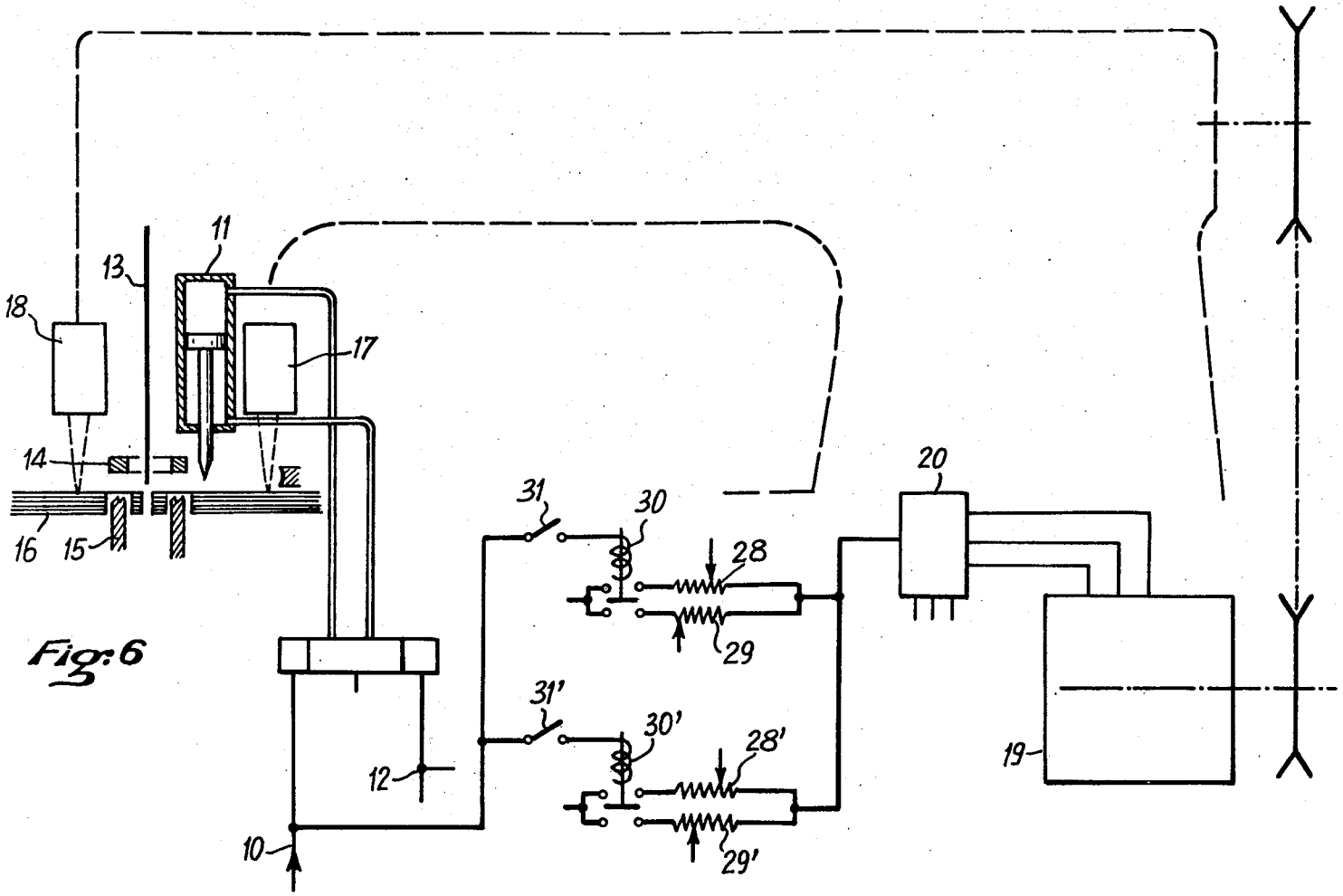
FIG. 6 is a schematic view of the apparatus for speed regulation.

In FIGS. 5 and 6, reference numeral 10 designates the signal input to the detector which controls the raising of the presser foot 11. Reference numeral 13 designates the needle, reference numeral 14 the yoke, reference numeral 15 the driving teeth, reference numeral 16 the needle plate, reference numeral 17 the photoelectric cell comprising the rotation control detector, reference numeral 18, the photoelectric cell for starting and stopping the motor of the machine, reference numeral 19, the motor, and reference numeral 20 the electronic control device of the speed of the motor.

FIG. 5 shows the schematic assembly view of the modification according to the invention as concerns the control of the stitch length. In this figure reference numeral 21 shows the slide lever of the machine which controls the stitch length, this lever moving toward + to increase the stitch length and toward − to shorten it. The normal length of the stitch is controlled by a micrometric stop 22 and the maximum length by the milled nut 23 on lever 21, the lever being urged toward "long" stitches by a spring 24 and toward "short" stitches by a jack 25 fed by a valve 26 controlled by means of a switch 27 upon signal input 12 to raise presser foot 11. As a result, at the beginning of a curve in the shape of the piece to be sewn, photoelectric cell 17 is uncovered, the control signal received at 12 stops and a control signal for applying presser foot 11 appears at input 10. As a result the jack 25 is no longer fed and, under the action of spring 24, the lever 21 moves to the long stitch position, for example 4.5 mm for a normal stitch length of 3 mm.

Simultaneously the control device of the speed shown in FIG. 6 comes into action. The device is comprised essentially by two regulable potentiometers 28 and 29 in the feed circuit of electronic device 20 for controlling the speed of motor 19. Potentiometer 28 corresponds to slow speed and is put in circuit by a relay 30 when presser foot 11 is applied by an input at 10. When there is no input at 10 it is the potentiometer 29 of high speed which is in circuit. The manual switch 31 permits putting the apparatus in circuit or out of circuit. A second or more speed control assemblies 28', 29', 30', 31' may be provided when the path of stitching comprises zones or the maximum speed must be reduced to produce curved stitching with a large radius of curvature separated by zones of small radius of curvature, the selection being effectuated manually with switches 31, 31'.

The embodiments described above are susceptible of numerous modifications without departing from the scope of the invention, the control in particular being able to be reversed so as to be controlled by signals at either of inputs 10 and 12.

What is claimed is:

1. In a sewing machine comprising automatic guide apparatus for the piece comprising a presser foot adapted to bear against the piece during operation so as to retard and turn the piece, a detector controlling the pressing of the presser foot, means for controlling the stitch length, and means for controlling the speed of operation of the machine; the improvement comprising means subjecting the means for regulating stitch length and the means for regulating the speed of driving of the piece to the actuation of the presser foot in such a way as to increase the stitch length and reduce the speed for as long as the presser foot is applied.

* * * * *